US006650056B2

(12) United States Patent
Kramer

(10) Patent No.: US 6,650,056 B2
(45) Date of Patent: Nov. 18, 2003

(54) STABILIZING SHORT-TERM COLOR TEMPERATURE IN A CERAMIC HIGH INTENSITY DISCHARGE LAMP

(75) Inventor: Jerry Martin Kramer, Yorktown Height, NY (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/023,522

(22) Filed: Dec. 21, 2001

(65) Prior Publication Data

US 2003/0117075 A1 Jun. 26, 2003

(51) Int. Cl.[7] ..... H01J 61/12; H01J 17/20

(52) U.S. Cl. ..... 313/637; 313/571

(58) Field of Search ..... 315/326, 56, 246; 313/637, 638, 639, 640, 641, 571, 565, 576; H01J 17/20, 61/12

(56) References Cited

U.S. PATENT DOCUMENTS

| | | | | |
|---|---|---|---|---|
| 4,634,927 A | * | 1/1987 | Mori et al. | 313/486 |
| 5,013,968 A | * | 5/1991 | Russell et al. | 313/641 |
| 5,382,873 A | * | 1/1995 | Scholl et al. | 313/570 |
| 6,031,332 A | | 2/2000 | Wijenberg et al. | |
| 6,157,141 A | * | 12/2000 | Lapatovich et al. | 315/248 |
| 6,184,633 B1 | | 2/2001 | Kramer | 315/246 |
| 6,300,729 B1 | | 10/2001 | Keijser et al. | 315/326 |
| 6,353,289 B1 | * | 3/2002 | Ishigami et al. | 313/637 |
| 6,486,603 B1 | * | 11/2002 | Ikeuchi et al. | 313/639 |
| 6,495,962 B2 | * | 12/2002 | Uemura et al. | 315/77 |
| 2002/0047526 A1 | * | 4/2002 | Ishigami et al. | 313/641 |

FOREIGN PATENT DOCUMENTS

| | | | |
|---|---|---|---|
| EP | 0215524 A1 | 3/1987 | H01J/61/30 |
| EP | 1 058 288 | 12/2000 | H01J/61/38 |
| WO | WO 00/45419 | 8/2000 | H01J/61/82 |
| WO | WO0067294 | 11/2000 | H01J/61/12 |

* cited by examiner

*Primary Examiner*—Don Wong
*Assistant Examiner*—Trinh Vo Dinh
(74) *Attorney, Agent, or Firm*—Ernestine C. Bartlett

(57) ABSTRACT

An apparatus and method for obtaining short-term color stability in an HID lamp, the apparatus comprising in a first embodiment a high intensity discharge lamp with a discharge vessel and electrodes; with a filling within the discharge vessel containing a metal halide dose of at least 20 mg/cc, where volume is defined as the volume of the main cylindrical section of the discharge vessel. In a preferred embodiment, the filling within the discharge vessel contains Hg of at least 20 mg/cc, where volume is defined as the volume of the main cylindrical section of the discharge vessel. In a yet further aspect, the resulting color temperature is stabilized independent of the shape and frequency of the current and voltage waveforms that drive the HID lamp.

16 Claims, 11 Drawing Sheets

STABILIZING SHORT-TERM COLOR TEMPERATURE IN A CERAMIC HIGH INTENSITY DISCHARGE LAMP

FIELD OF THE INVENTION

The present invention relates generally to the field of HID lamps, and more particularly to HID lamps with short-term color stability.

BACKGROUND OF THE INVENTION

Recently a new generation of ceramic high intensity discharge lamps that are long and thin have been disclosed. In this regard, see WO 00/45419. These lamps have higher efficacy compared to the original ceramic high intensity discharge lamps (aspect ratio close to 1) and better maintenance. One issue with these long and thin lamps is that the color temperature can vary by hundreds of degrees Kelvin over a period of hours. This variation can be quite noticeable to the end user, especially when multiple lamps are utilized.

The design of ceramic high intensity discharge lamps includes the main cylindrical lamp discharge vessel with smaller diameter ceramic feedthoughs at each end. The electrodes pass through the feedthroughs into the main cylindrical lamp discharge vessel. The metal halide chemistry (also called condensate) that is added to the lamp mostly remains in the main cylinder, but some of it collects in the annular space between the electrodes and the smaller diameter inner wall of the feedthroughs. The metal halide condensate that vaporizes in the lamp and enters the discharge largely determines the spectrum of the discharge and hence its color temperature. The composition of the vapor that enters the discharge is determined both by the temperature of the condensate and its chemical composition. Two typical components of the metal halide chemistry are sodium iodide and cerium iodide. The ratio of these two metals in the discharge will strongly influence the spectrum and the color temperature. A discharge richer in cerium will have a high color temperature, while one richer in sodium will have a lower color temperature. The lamp tends to cycle between these two extremes. When the discharge is rich in sodium the current is high and the voltage is low. The discharge is more diffuse radially. When the discharge is rich in cerium the current is lower and the voltage is higher. The discharge is more constricted radially. Through a process that is not well understood the lamp cycles between these extremes. The presence of condensate in the smaller diameter feedthrough seems to be involved in this color temperature instability. The observed time constants of many hours suggest a thermal process involving the condensate.

There are many variables in designing ceramic high intensity discharge lamps. In addition to the overall dimensions of the lamp, the size and insertion length of the electrode (tip to bottom distance) can be controlled. The length of the feedthrough can also be adjusted. This feedthrough length adjustment is the approach taken to control color temperature by Matsushita Electronics and described in European Patent Application EP 1058288.

SUMMARY OF THE INVENTION

Briefly, the present invention comprises, in a first embodiment, an HID lamp with short-term color temperature stability, comprising: a high intensity discharge lamp with a discharge vessel and electrodes; and a filling within the discharge vessel containing a metal halide dose of at least 20 mg/cc, where volume is defined as the volume of the main cylindrical section of the discharge vessel.

In a further aspect of the present invention, the filling within the discharge vessel contains Hg of at least 20 mg/cc, where volume is defined as the volume of the main cylindrical section of the discharge vessel.

In a further aspect of the present invention, the color temperature is stabilized independent of the shape and frequency of the current and voltage waveforms that drive the HID lamp.

In a further aspect of the present invention, the color temperature is stabilized independent of the shape and frequency of the current and voltage waveforms that drive the HID lamp.

In a further aspect of the present invention, the HID lamp discharge vessel has an inner length/inner diameter ratio equal to or greater than 3.

In a further aspect of the present invention, the HID lamp discharge vessel has an inner length/inner diameter ratio equal to or greater than 4.75.

In a further aspect of the present invention, the filling includes cerium.

In a further aspect of the present invention, the filling within the discharge vessel contains a metal halide dose of at least 24 mg/cc, where the volume is defined as the volume of the main cylindrical section of the discharge vessel.

In a further aspect of the present invention, the filling within the discharge vessel contains Hg of at least 24 mg/cc, where the volume is defined as the volume of the main cylindrical section of the discharge vessel.

In a further embodiment of the present invention, a method is provided for obtaining short-term color stability in an HID lamp, comprising the steps of: providing a high intensity discharge lamp with a discharge vessel and electrodes; and filling the discharge vessel with a metal halide dose to at least 20 mg/cc, where the volume is defined as the volume of the main cylindrical section of the discharge vessel.

FIG., 5A–5D comprise graphs of color temperature vs. time and voltage vs. time for lamps MFX 22-48 and 22-47 with increased mercury pressure, increased tip-to-bottom distance, compared to MFX 22-9 for a vertical lamp position and FM+AM drive as well as in horizontal orientation with FM drive.

FIGS. 6A–6D comprise graphs of color temperature vs. time and voltage vs. time for lamps H01-02 and H01-03 with an increased metal halide dose for a horizontal lamp position and FM plus AM drive as well as in vertical orientation with an FM+AM drive.

FIGS. 7A–7D comprise graphs of color temperature vs. time and voltage vs. time for lamp H01-02 with an increased metal halide dose for a horizontal lamp position with an FM drive and an LF square wave drive.

DETAILED DESCRIPTION OF THE PREFERRED EMBODIMENTS

A method and a structure for an HID lamp to achieve short-term color temperature stability has been discovered. The structure of the lamp comprises a high intensity discharge lamp with a discharge vessel and electrodes; and a filling within the discharge vessel containing metal halides of at least 20 mg/cc. In a preferred embodiment, this filling will also contain Hg of at least 20 mg/cc. An HID lamp with this structure has the characteristic that the color temperature is stabilized independent of the shape and frequency of the current- and voltage waveforms that drive the HID lamp.

Figure 1:
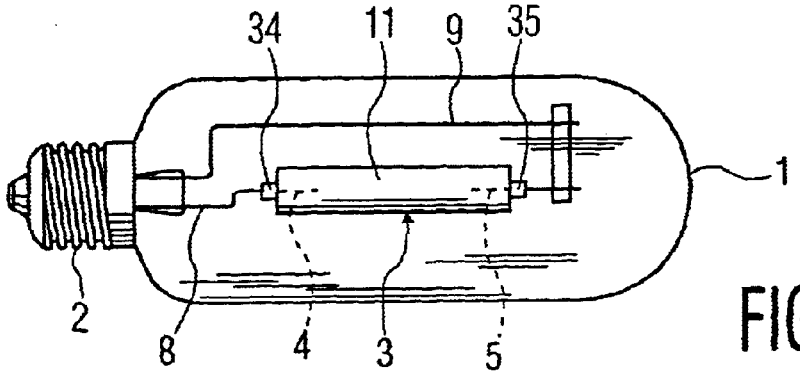
FIG. 1 is a schematic diagram of an HID lamp that may be used to implement an embodiment of the present invention.
Figure 2:
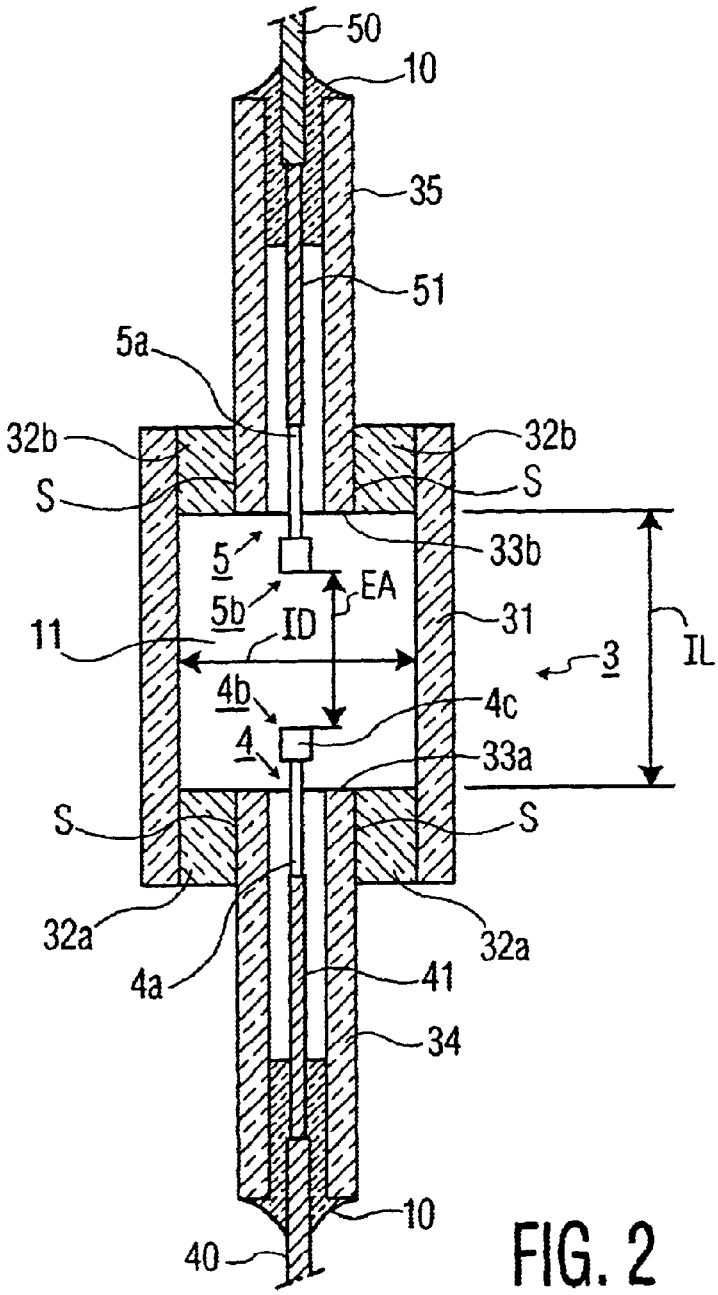
FIG. 2 is a cross-section of a discharge vessel of the lamp shown in FIG. 1
Figure 3A:
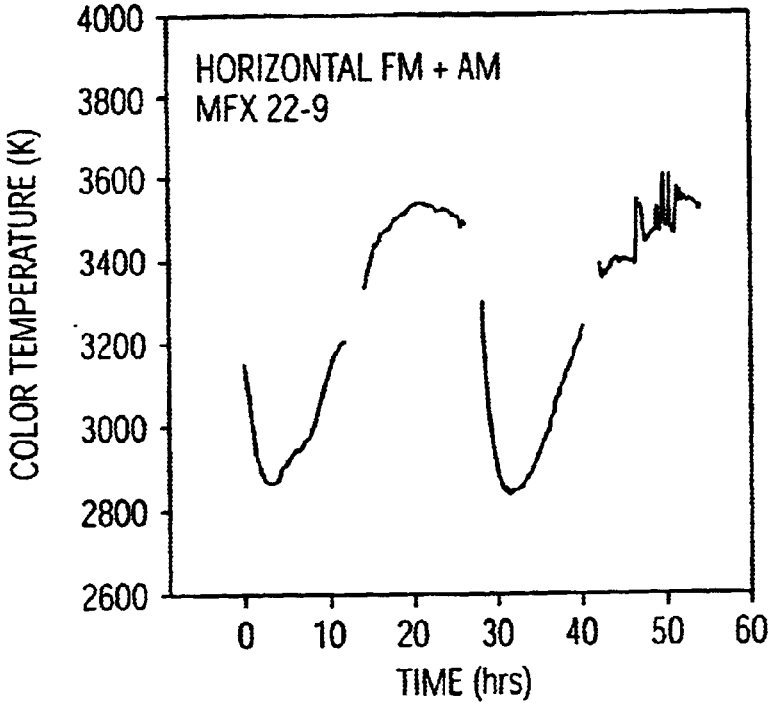
FIGS. 3A–3D comprise graphs of color temperature vs. time and voltage vs. time for lamp MFX 22-9 for a horizontal lamp position and FM plus AM operating condition as well as in vertical orientation with FM+AM.
Figure 3B:
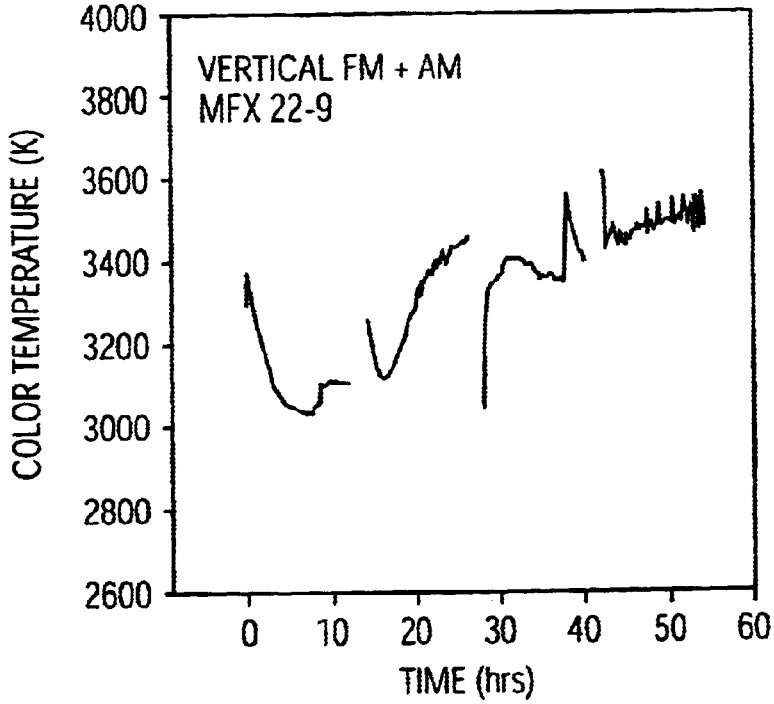
Figure 3C:
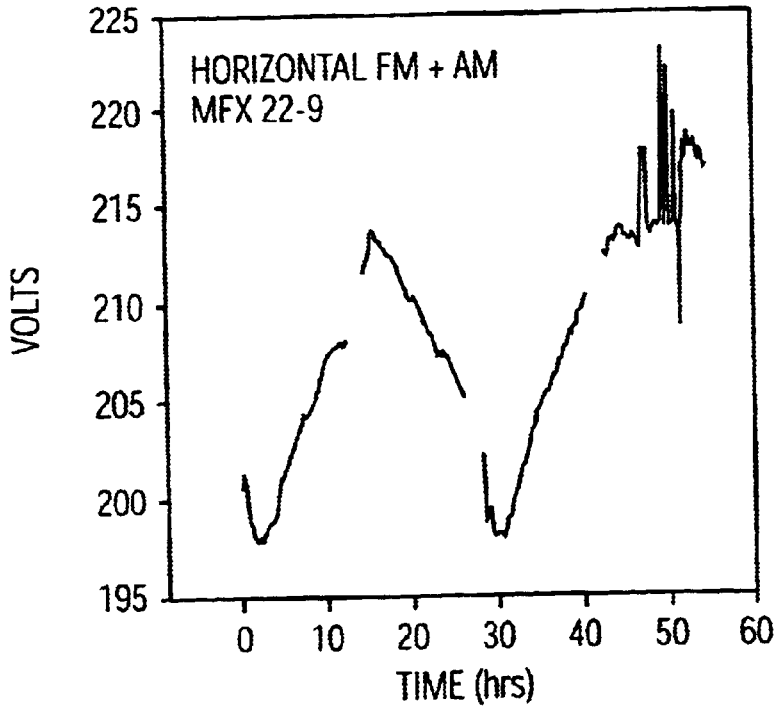
Figure 3D:
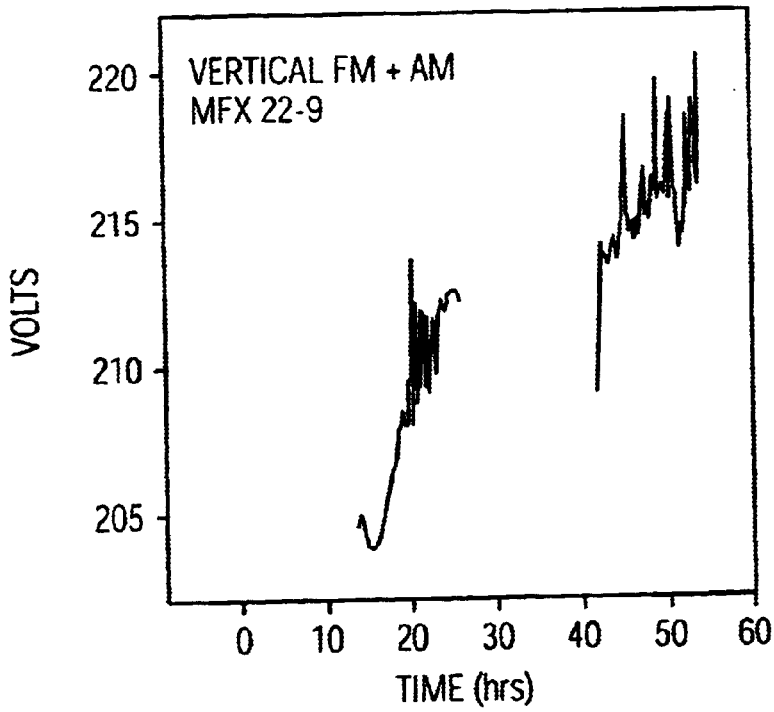
Figure 4A:
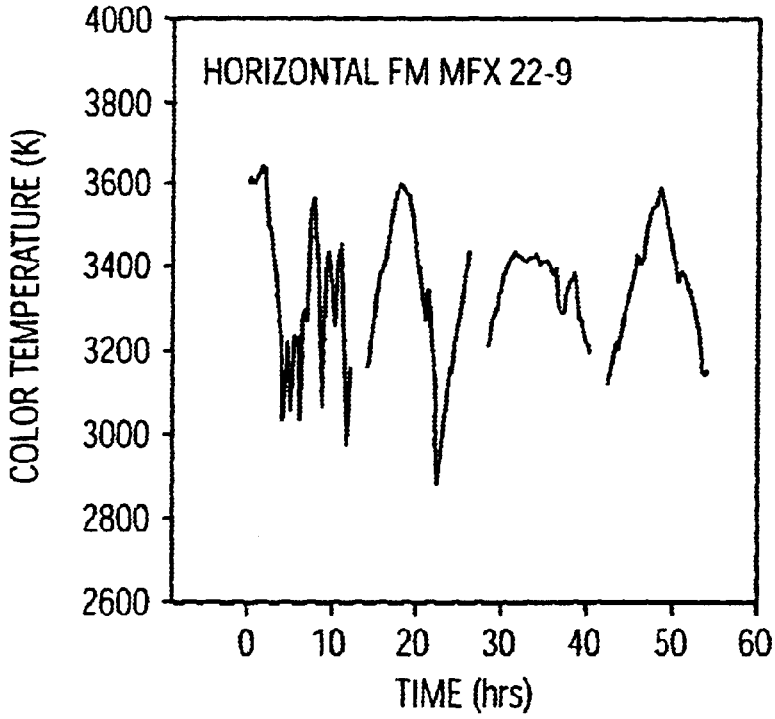
FIGS. 4A–4D comprise graphs of color temperature vs. time and voltage vs. time for lamp MFX 22-9 for a horizontal lamp position with an FM drive and an LF square wave drive.
Figure 4B:
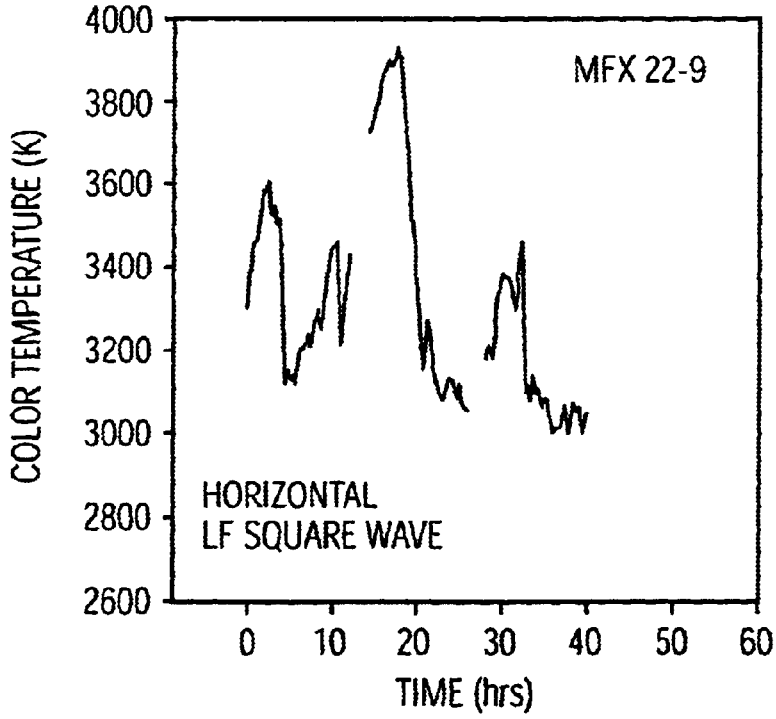
Figure 4C:
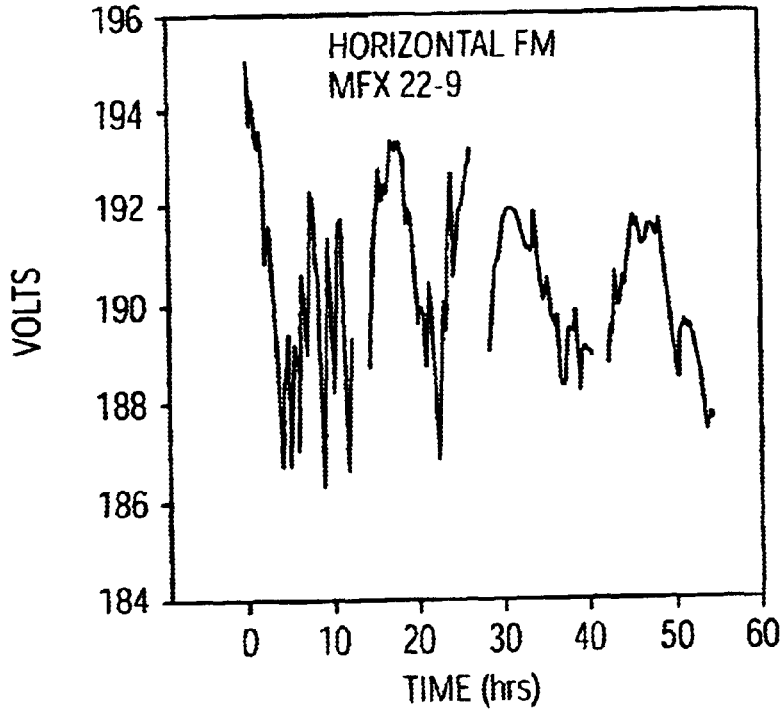
Figure 4D:
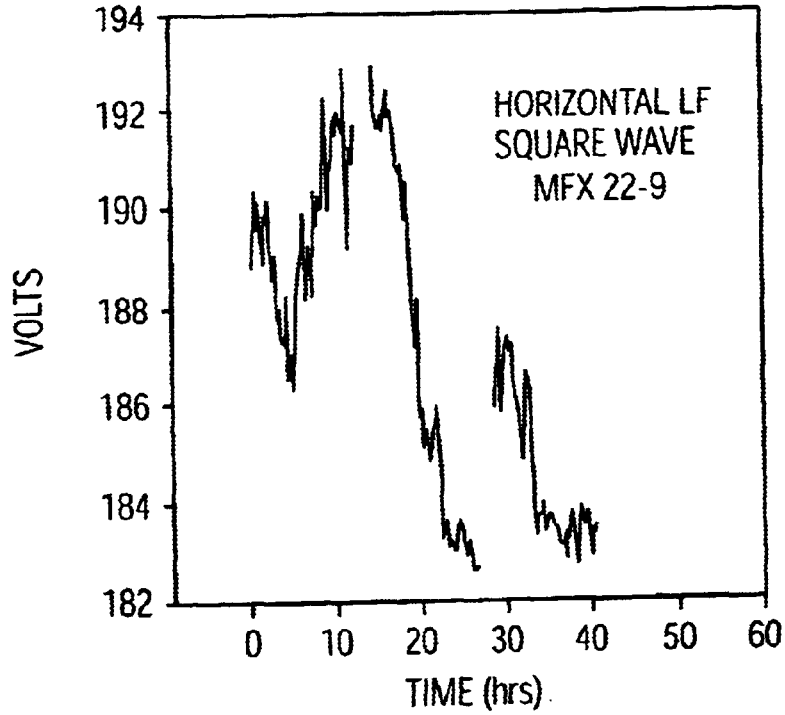
Figure 5A:
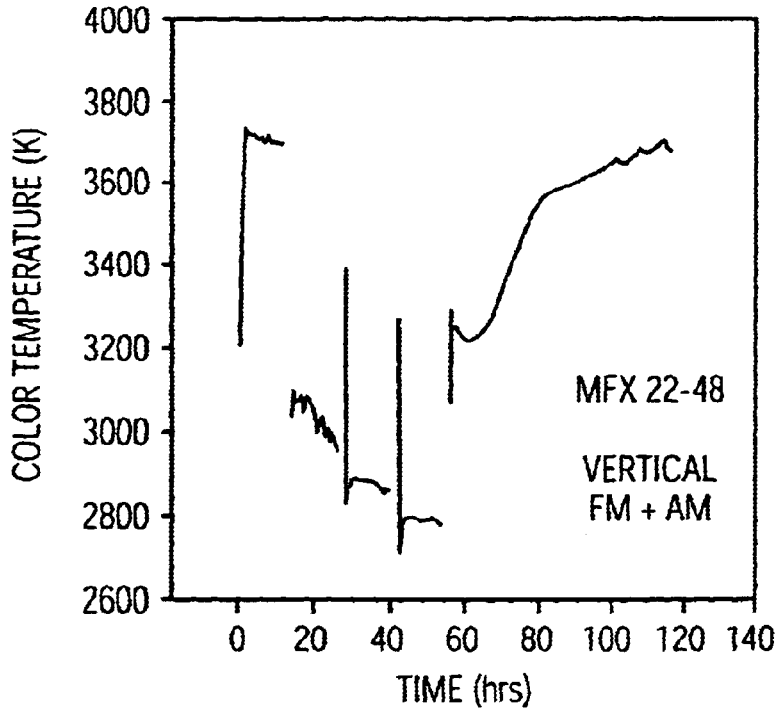
Figure 5B:
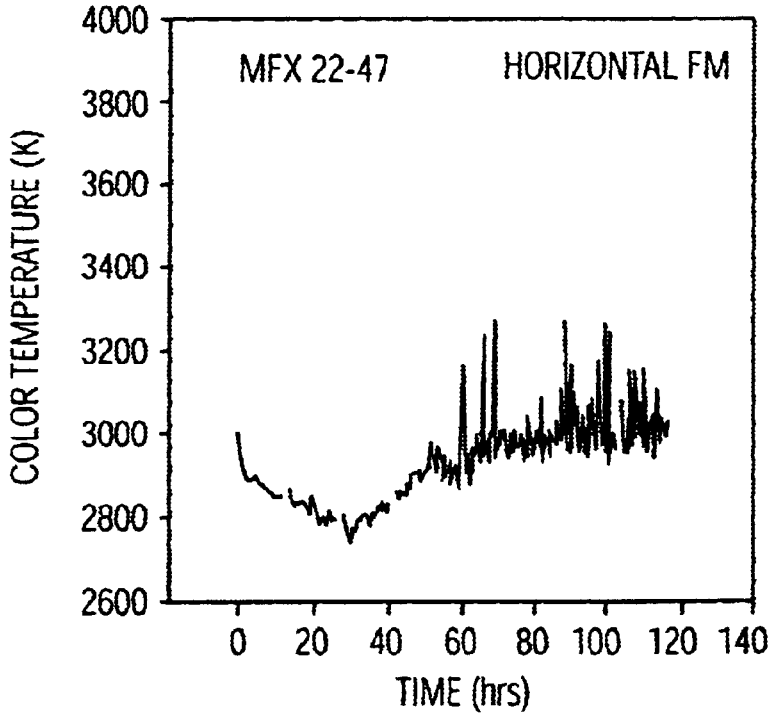
Figure 5C:
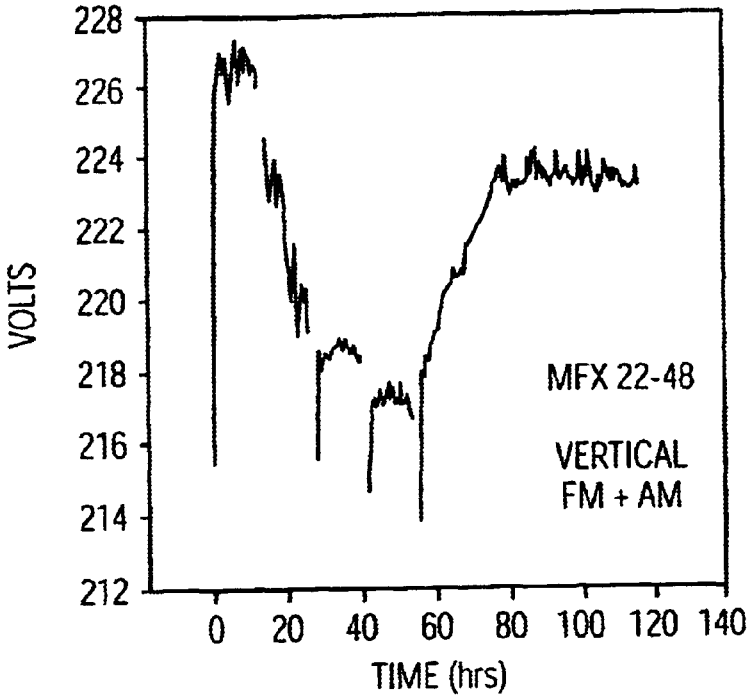
Figure 5D:
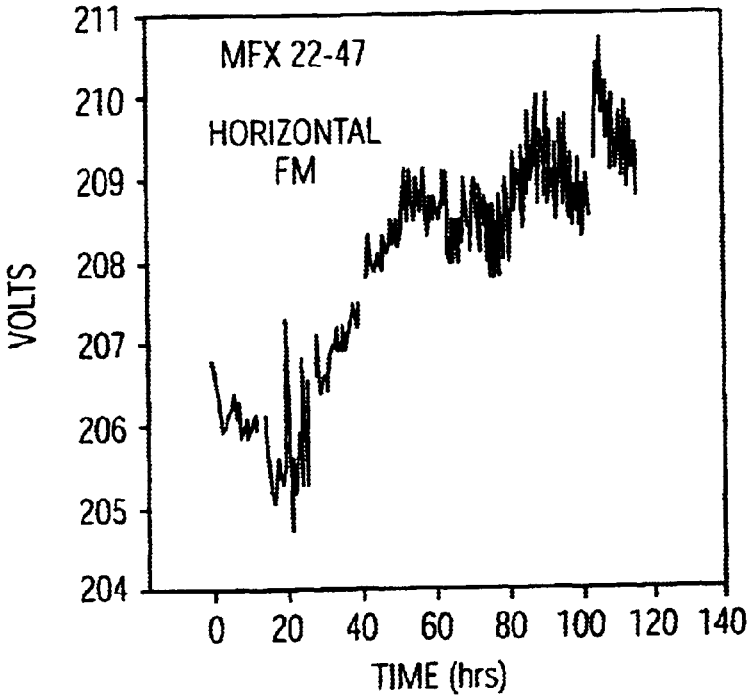
Figure 6A:
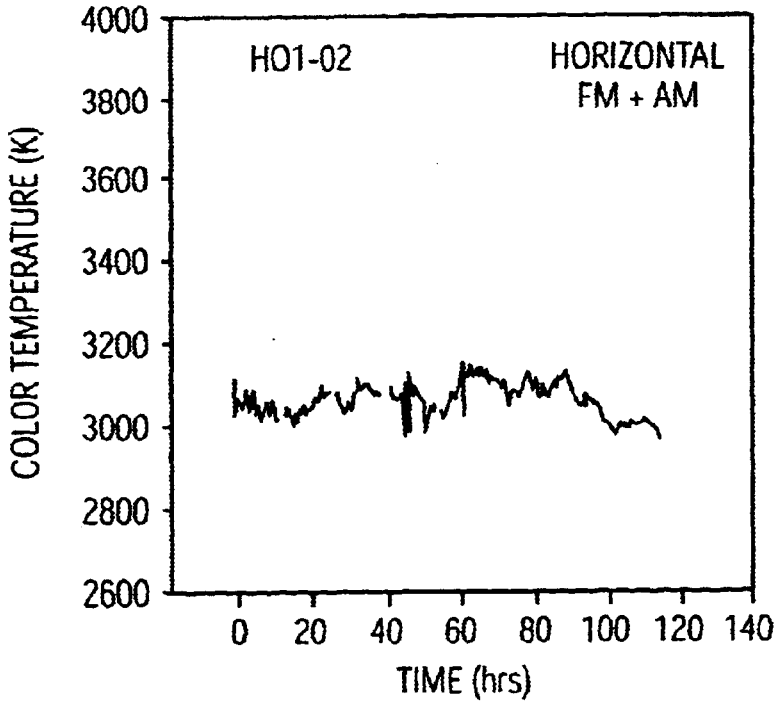
Figure 6B:
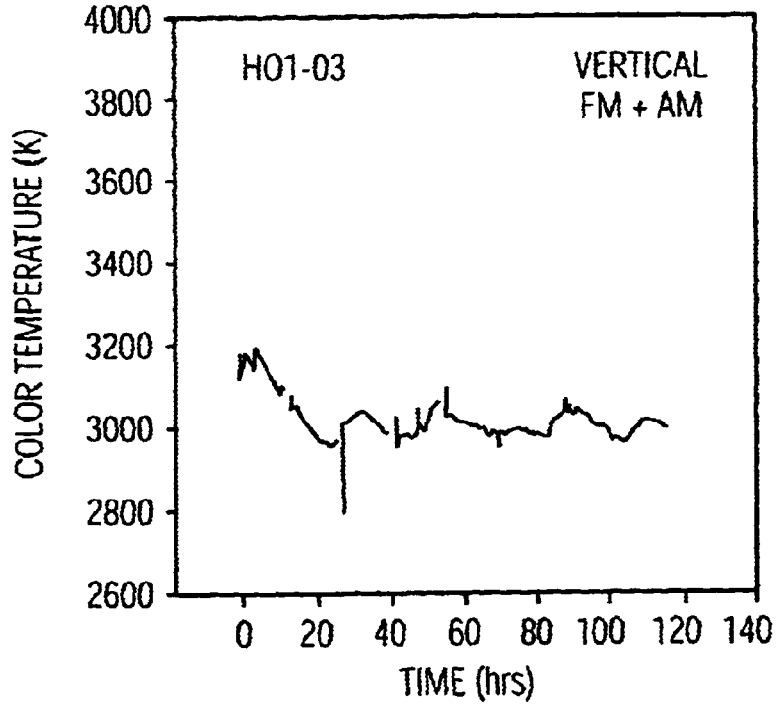
Figure 6C:
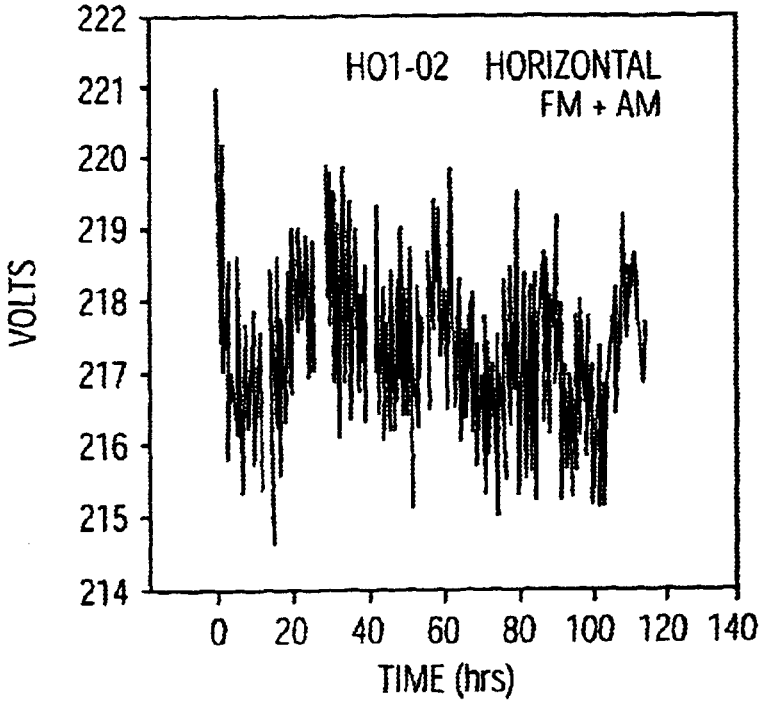
Figure 6D:
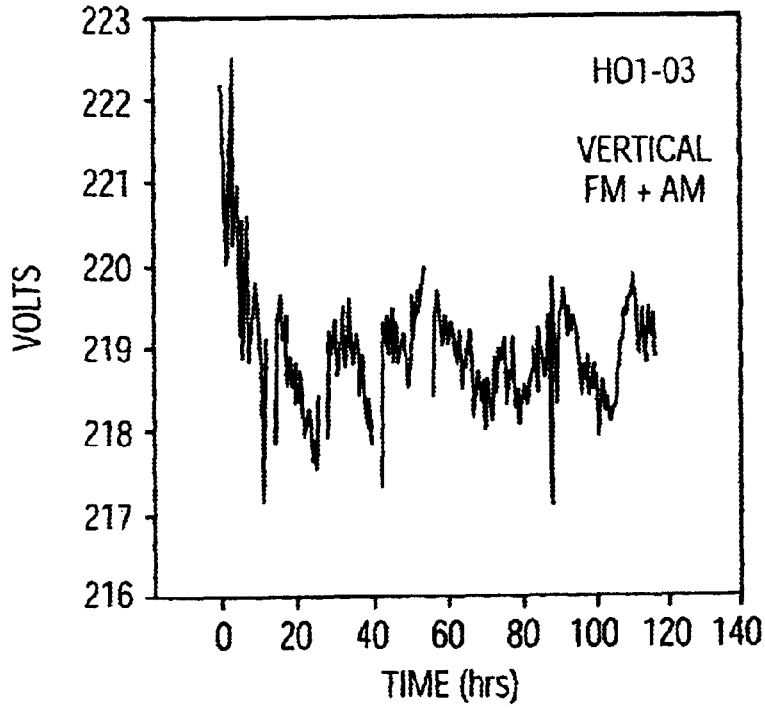
Figure 7A:
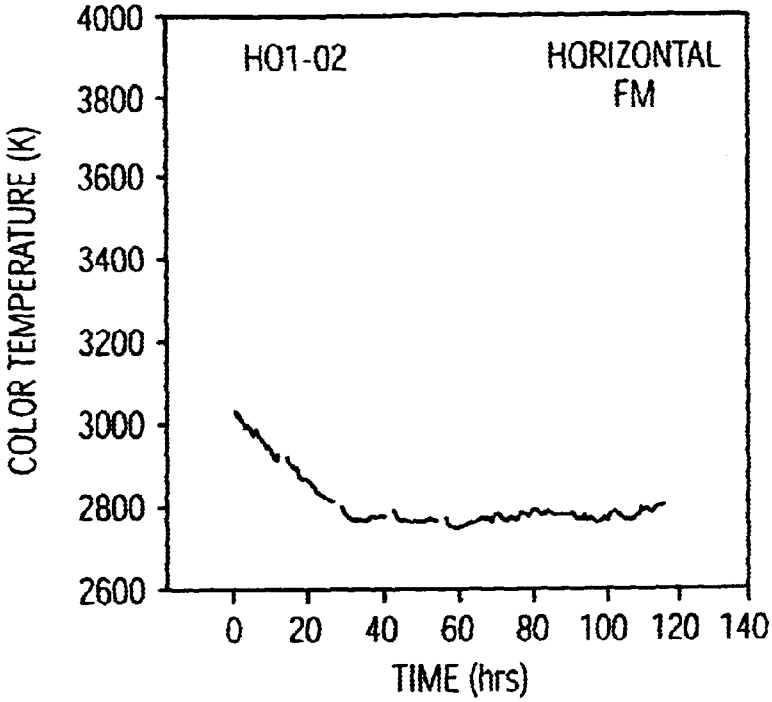
Figure 7B:
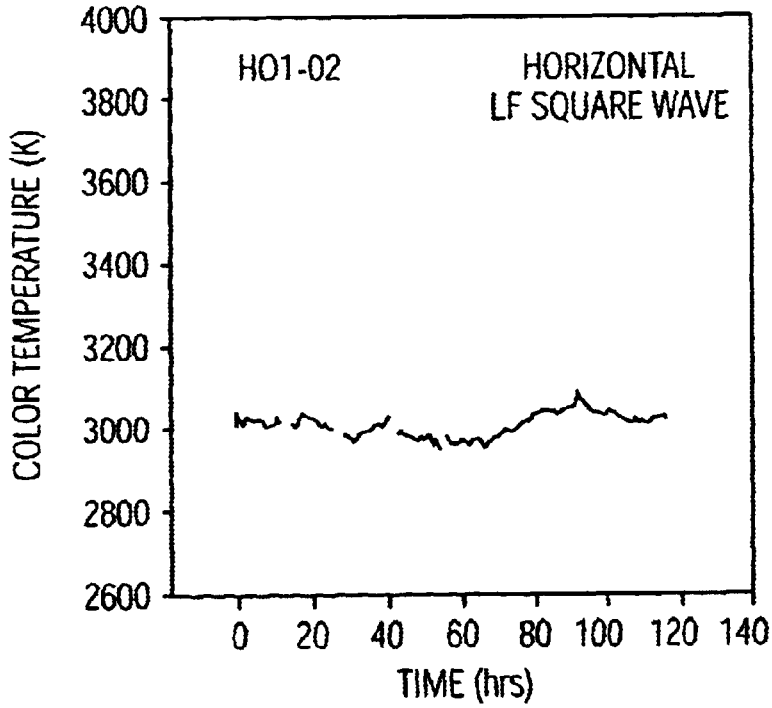
Figure 7C:
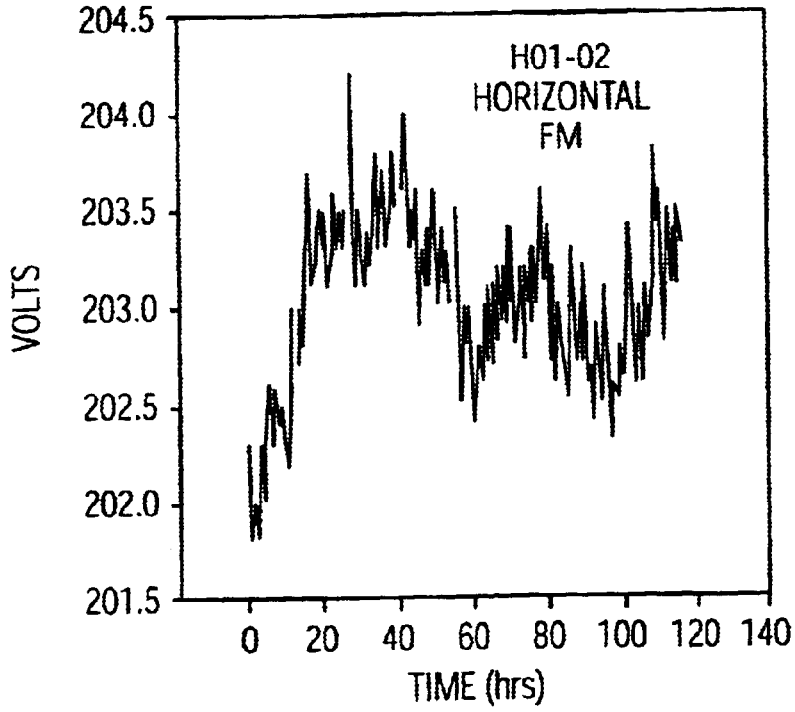
Figure 7D:
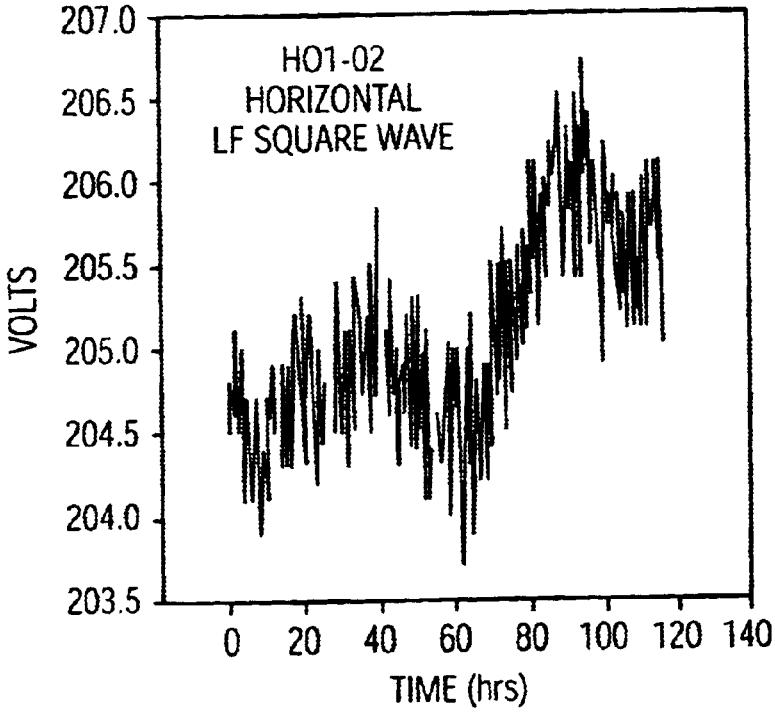

The specific hardware to be illustrated in the drawings is for ease of explanation only. Thus, the invention is in no way limited to one particular hardware configuration. However, for purposes of explanation, details will be provided of one embodiment of an HID lamp that may be implemented with the present invention. Referring now to FIG. 1, a metal halide lamp is shown comprising a discharge vessel 3, with details of the discharge vessel 3 shown in a cross-section and not to scale in FIG. 2. The discharge vessel 3 is shown to include a ceramic wall enclosing a discharge space 11 which contains an ionizable filling in the lamp. In a preferred embodiment, the ionizable filling includes Hg and a quantity of metal halide chemistries. The metal halide chemistry typically includes one or more of Na halides, TI, Dy and Ce halides. Two electrodes 4, 5 with electrode bars 4*a*, 5*a* and tips 4*b*, 5*b* are arranged in the discharge space with a distance EA therebetween, in the drawing. The discharge vessel has an internal diameter Di at least through the distance EA. The discharge vessel is sealed at the ends by ceramic projecting plugs 34, 35 which tightly encloses a current feedthrough conductor 40, 41 and 50, 51 which connect to the electrodes 4, 5 arranged in the discharge vessel in a gastight manner by means of a melt-ceramic compound 10 near one end remote from the discharge space. The discharge vessel 3 is enclosed by an outer envelope 1 provided at one end with a lamp cap 2. In the operational state of the lamp, a discharge extends between the electrodes 4, 5. Electrode 4 is connected via a current conductor 8 to a first electric contact which forms part of the lamp cap 2. Electrode 5 is connected via a current conductor 9 to a second electric contact which forms part of the lamp cap 2. The metal halide lamp shown is intended to be operated with an electronic ballast, as described in more detail in U.S. Pat. No. 6,300,729, which is hereby incorporated by reference, or a magnetic ballast, or other convenient ballast. Note that the above-described configuration for the HID lamp is provided for purposes of explaining the invention, but the invention is in no way limited to this configuration.

Note that the chemistries for the ionizable filling may be implemented in a variety of formulations. However, the present invention is limited only by the formulations disclosed in the claims.

Referring now to experiments that formed part of the basis for the present invention, the short-term (15–60 minutes) color temperature stability of a number of ceramic metal halide lamps was studied. These lamps were operated in an integrating sphere and a spectrum was taken every 5 minutes. The lamp voltage, current and power were measured and recorded every time a spectrum was taken. All of the lamps were designed for 70 W with an inner diameter of 4 mm and an inner length of 19 mm. The chemical fill comprised NaI, TlI, $DyI_3$ and $CeI_3$ in a molar % ratio of 85.2/3.6/4.9/6.2/. The variables included an Hg dose, metal halide dose, wall thickness of the main cylindrical body, and electrode insertion length (tip to bottom distance). The lamps investigated are shown in Table 1. The mercury pressure in the operating discharge vessel was calculated using the ideal gas equation, PV=nRT, where P is the pressure, V is the volume of the 4 mm ID by 19 mm IL cylindrical section, n is the number of moles of mercury, R is the ideal gas constant and T is thee average temperature (assumed equal to 2500K).

TABLE I

| | Lamp variables | | | | |
|---|---|---|---|---|---|
| Lamp # | Hg dose (mg) | Calculated Hg pressure (atm) | Metal halide dose (mg) | tip-to bottom distance (mm) | Wall thickness (mm) |
| MFX 22-9 | 3.71 | 15.9 | 4 | 1 | 0.8 |
| MFX 22-47 | 6.18 | 26.5 | 4 | 2 | 1.2 |
| MFX 22-48 | 6.18 | 26.5 | 4 | 2 | 1.2 |
| H01-02 | 5.76 | 24.7 | 5.76 | 2 | 1.2 |
| H01-03 | 5.76 | 24.7 | 5.76 | 2 | 1.2 |

The color temperatures were measured every 5 minutes for periods of 12 or 60 hours. In horizontal orientation the lamps were operated with a low frequency (~90 Hz) square wave ballast, with a HF sweep from 45 to 55 kHz (FM), or with an HF sweep from 45 to 55 kHz that is amplitude modulated at ~24 kHz to excite the $2^{nd}$ longitudinal acoustic mode (FM+AM). In vertical orientation only the HF sweep from 45 to 55 kHz that is amplitude modulated at ~24 kHz was used. The amplitude modulated HF sweep is designed to reduce vertical segregation and provide a lamp with universal burning position (i.e. equal color temperature). (For a discussion of an amplitude modulated HF sweep, see U.S. Pat. No. 6,184,633.) Without the amplitude modulation the color temperature in vertical orientation would be much higher and the color rendering index much lower.

In FIGS. 3 and 4 the color temperatures and voltages of lamp MFX 22-9 are shown vs. time for three different horizontal operating conditions as well as in vertical orientation with FM+AM. (The lamp was extinguished for about 8–12 hours between runs, but is shown as 2 hours for clarity in all the FIGS. 3–7.) In all four cases the color temperature was unstable, varying by as much as ~900K with a low frequency square wave ballast. There was a large spread in lamp voltage. The shape of the voltage and color temperature vs. time curves was similar.

Lamps MFX 22-48 and MFX 22-47 with increased mercury pressure, increased tip to bottom distance and increased wall thickness compared to MFX 22-9 are shown in FIG. 5. The color temperature of MFX 22-48 in vertical orientation with FM+AM varied over almost 1000 K. Lamp MFX 22-47 showed some short-term color temperature spikes when operated horizontally with FM. Thus, the changes made in MFX 22-47 or MFX 22-48, compared to MFX 22-9, are not sufficient to stabilize the short-term color temperature.

In FIGS. 6 and 7 the color temperature and voltage are shown for lamps H01-02 and H01-03. The difference between H01-02 or H01-03 and MFX 22-47 or MFX 22-48 is the increased metal halide dose. Except for an initial reequilibration in the horizontal FM case and the vertical FM+AM case, the color temperatures were stable over the 112 hours of data taking. From earlier measurements, it was found that lamps with the same variables as H01-02 or H01-03, but only 15 bar of Hg pressure had unstable color temperatures vs. time.

Based on these measurements it was concluded that for 70 W ceramic lamps with 4 mm ID and 19 mm IL stable short term color temperature can be attained with a Hg pressure of ~25 atm, metal halide fill of 5.76 mg, tip to bottom distance of 2 mm and wall thickness of 1.2 mm. More generally the solution to short term color temperature instabilities in long and thin burners is to first increase the metal halide dose. Then to increase the mercury pressure. To put the parameters of the invention in a more generic form, there should be a metal halide fill of at least 20 mg/cc. In a preferred embodiment, it is preferred that a mercury fill of at least 20 mg/cc also be present.

As shown in FIGS. 3, 4, 6 and 7 the excitation scheme does not have a major influence on color temperature stability. Lamps that have stable color temperature are stable with all the excitation schemes and conversely, lamps with unstable color temperatures are unstable with all excitation schemes.

Two lamps with the same mercury and metal halide doses, tip to bottom distance and wall thickness as H01-02 or H01-03 have been operated vertically for over 14,500 hours with a time sequential method of reducing vertical segregation (see U.S. Pat. No. 6,184,633). The color temperatures have been measured 11 times during the 14,500 hours. The average color temperature and standard deviation. (shown in parentheses) for the two lamps are 3081 (134) and 3106 (59). These results show very good long-term color temperature stability and very good agreement between the two lamps. If there were a short-term color temperature stability issue with these lamps it would be expected to show up in these measurements taken at random times.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined the claims appended hereto, and their equivalents.

What is claimed is:

1. An HID lamp with short-term color temperature stability, comprising:

a high intensity discharge lamp with a discharge vessel and electrodes, and a filling within the discharge vessel containing a metal halide dose per unit volume of at least 20 mg/cc, where volume is defined as the volume of the main cylindrical section of the discharge vessel and wherein the HID lamp discharge vessel has an inner length/inner diameter ratio equal to or greater than 3.

2. The HID lamp as defined in claim 1, wherein the filling within the discharge vessel contains Hg of at least 20 mg/cc.

3. The HID lamp as defined in claim 2, wherein a color temperature is stabilized independent of a shape and frequency of current and voltage waveforms that drive the HID lamp.

4. The HID lamp as defined in claim 1, wherein a color temperature is stabilized independent of a shape and frequency of current and voltage waveforms that drive the HID lamp.

5. The HID lamp as defined in claim 1, wherein the filling includes cerium.

6. The HID lamp defined in claim 1, wherein the filling within the discharge vessel contains a metal halide dose of at least 24 mg/cc.

7. The HID lamp as defined in claim 6, wherein the filling within the discharge vessel contains Hg of at least 24 mg/cc.

8. A HID lamp with short-term color temperature stability, comprising:

a high intensity discharge lamp with a discharge vessel and electrodes, and a filling within the discharge vessel containing a metal halide dose per unit volume of at least 20 mg/cc, where volume is defined as the volume of the main cylindrical section of the discharge vessel, and wherein the HID lamp discharge vessel has an inner length/inner diameter ratio equal to or greater than 4.75.

9. A method for obtaining short-term color stability in an HID lamp, comprising the steps of:

providing a high intensity discharge lamp with a discharge vessel and electrodes; and filling the discharge vessel with a metal halide dose per unit volume to at least 20 mg/cc, where the volume is defined as the volume of the main cylindrical section of the discharge vessel and wherein the HID lamp discharge vessel has an inner length/inner diameter ratio equal to or greater than 3.

10. The method as defined in claim 9, wherein the filling step comprises filling the discharge vessel with Hg to at least 20 mg/cc.

11. The method as defined in claim 10, wherein a color temperature of the lamp is stabilized independent of a shape and frequency of current and voltage waveforms that drive the HID lamp.

12. The method as defined in claim 9, wherein a color temperature of the lamp is stabilized independent of a shape and frequency of current and voltage waveforms that drive the HID lamp.

13. The method as defined in claim 9, wherein the filling step includes cerium in the fill.

14. The method defined in claim 9, wherein the filling step fills the discharge vessel with the metal halide dose to at least 24 mg/cc.

15. The method as defined in claim 14, wherein the filling step fills the discharge vessel with Hg to at least 24 mg/cc.

16. A method for obtaining short-term color stability in an HID lamp, comprising the steps of:

providing a high intensity discharge lamp with a discharge vessel and electrodes; and filling the discharge vessel with a metal halide dose per unit volume to at least 20 mg/cc, where the volume is defined as the volume of the main cylindrical section of the discharge vessel, and wherein the HID lamp discharge vessel has an inner length/inner diameter ratio equal to or greater than 4.75.

* * * * *